United States Patent [19]

King

[11] Patent Number: 4,909,059

[45] Date of Patent: Mar. 20, 1990

[54] METAL TUBING BENDER

[76] Inventor: William E. King, 6758 S. Heggenes Rd., Clinton, Wash. 98236

[21] Appl. No.: 250,976

[22] Filed: Sep. 23, 1988

Related U.S. Application Data

[63] Continuation-in-part of Ser. No. 114,705, Oct. 30, 1987, abandoned.

[51] Int. Cl.[4] ..... B21D 7/03

[52] U.S. Cl. ..... 72/217; 29/132; 72/215; 72/219

[58] Field of Search ..... 72/217, 218, 219, 215, 72/216; 29/132

[56] References Cited

U.S. PATENT DOCUMENTS

| | | | |
|---|---|---|---|
| 784,471 | 3/1905 | Church | 72/217 X |
| 1,239,165 | 9/1917 | Davis et al. | 72/217 |
| 1,682,149 | 8/1928 | Robertson | 72/217 |
| 2,153,935 | 4/1939 | Neukirch | 72/217 |
| 2,414,926 | 1/1947 | Burke | 72/217 |
| 3,444,716 | 5/1969 | Martin | 29/132 |
| 3,606,786 | 9/1971 | Taylor | 72/217 X |
| 3,732,721 | 5/1973 | Cusimano | 72/217 X |
| 4,055,065 | 10/1977 | Whetstone, Jr. et al. | 72/217 |
| 4,091,845 | 5/1978 | Johnson | 72/217 X |
| 4,351,178 | 9/1982 | Uehara et al. | 72/217 X |

FOREIGN PATENT DOCUMENTS 0515269 3/1921 France .

*Primary Examiner*—W. Donald Bray
*Attorney, Agent, or Firm*—Harry M. Cross, Jr.

[57] ABSTRACT

A metal tubing bender forms arcs into metal tubing by engaging a swing-arm mounted roller against a clamped tubing section and rotating the roller through an arc necessary to place the desired degrees of bend into the tubing. The tubing is clamped against a forming plate that is provided with a peripheral groove of uniform radius and serves as a die for the forming operation. The forming plate stands out from a mounting plate and the roller swing arm fits between the mounting plate and the forming plate for stability of operation.

9 Claims, 2 Drawing Sheets

METAL TUBING BENDER

This application is a continuation-in-part, of application Ser. No. 114,705 filed Oct. 30, 1987 now abandoned.

FIELD OF THE INVENTION

This invention pertains to devices for bending metal tubing and specifically to such devices for bending metal tubing for use in a marine environment.

Metal tubing, either stainless steel or aluminum, is formed by rolling and bending into various shapes for use on boat tops, hand rails and the like. Smaller boats such as pleasure craft often have canvas tops supported by metal tubing frames. Frequently, these frames are adjustable so that the top is convertible. The metal tubing frames for such tops must be formed carefully so that the convertible mechanism will work smoothly when the top is raised and lowered. Moreover, in convertible top manufacturing, the metal tubing must be consistently formed from one set to another so that the tubing sets will fit the manufactured fabric tops.

Heretofore, manufacturers of boat convertible tops have formed their tubing frames by means that did not produce consistent results. The arcs through which frame sections were bent to provide transitions between a frame leg segment and a frame overhead segment could not be uniformly maintained without time consuming effort and attention to detail.

SUMMARY OF THE INVENTION

A primary object of the present invention is to provide a manually-operated tubing bender that can easily and conveniently bend tubing to anywhere from a few degrees up to 95 degrees or more. Another object is to provide such a device that can be wall-mounted and provided with a self-contained tubing clamp to insure accurate bending. A further object is to provide such a device that is simple to assemble and maintain, and yet sturdy for years of trouble-free operation.

The tubing bender of this invention comprises a tube bending plate formed with a peripheral curved groove, a clamp member to hold a metal tube section in place at the beginning of the forming plate groove, and a forming roller mounted on a pivot arm to bend a section of clamped tubing around the forming plate until the tubing is conformed to the curvature of the plate groove through the desired degrees of arc. The forming plate, forming roller and tubing clamp are mounted onto a flat mounting bracket designed for wall mounting. The mounting bracket itself may be directly mounted to a wall or post or it may be mounted to an adjustable rail system which in turn may be mounted to a wall.

DETAILED DESCRIPTION OF THE INVENTION

Figure 2:
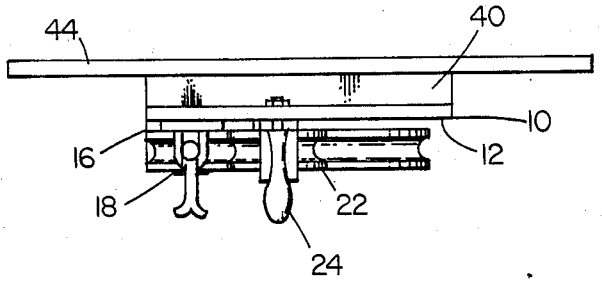
FIG. 2 is a top view of the bender of FIG. 1.
Figure 1:
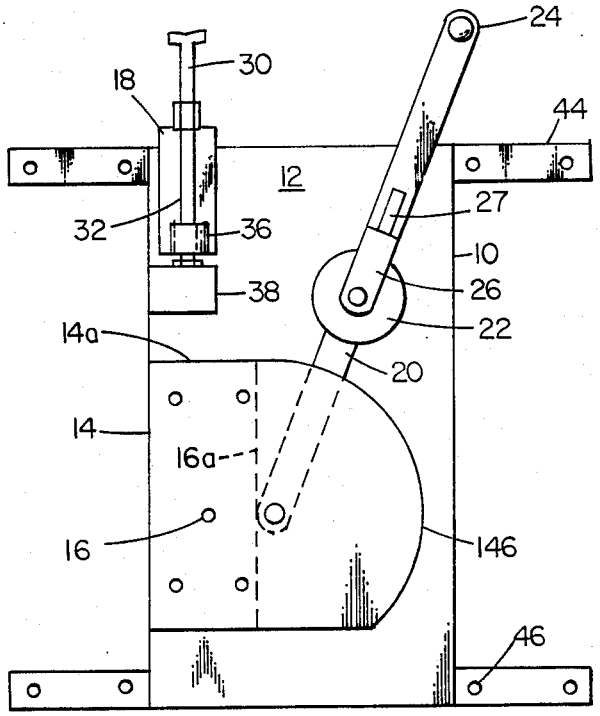
FIG. 1 is a front elevation view of the tube bender of this invention.
Figure 4:
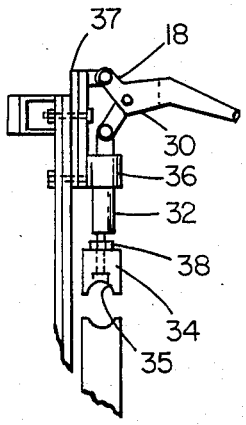
FIG. 4 is a side view of the tubing claim section of the bender of FIG. 1.

The components of the metal tubing bender of this invention are mounted on a rectangular steel plate 10. The face of plate is covered with a sheet 12 of formica or other smooth, hard non-metallic material. A grooved forming plate 14 is bolted to plate 10 and spaced therefrom by a rectangular shim plate 16. A tube clamping assembly 18 is mounted in the upper corner of plate 10 above the shim plate 16. A forming roller arm 20 is mounted to plate 10 between the exposed formica surface and the backside of the forming plate 14 for pivotal movement about its point of connection. Arm 20 mounts a forming roller 22 and a turning handle 24.

Forming plate 14 is made from No. 101 Nylon plate. Its periphery contains a horizontal upper section **14*a* beneath clamping assembly 18 and a curved section 14*b* having a uniform radius proceeding from a tangent with upper section 14*a* and around through an arc of about 135 degrees. This periphery, 14*a*–14*b*, is grooved with a semicircular cross-sectioned groove. At the center of the radiused section 14*b*, forming arm 20 is pivotally mounted to mounting plate 10 by means of a bolt and bearing assembly 21 extended through forming plate 14 and mounting plate 10**.

Shim plate 16 is located between forming plate 14 and mounting plate 10 at the rearward portion of forming plate 14 as shown. The thickness of the shim plate is about that of forming arm 20, slightly more; so that the gap between the inner face of the forming plate and the outer face of the formica on mounting plate 10 is just barely wide enough to receive the forming arm as it is swung in its arc during a tube-bending operation. Shim plate 16 has an inner vertical edge **16*a* that provdes a stop for counterclockwise rotative movement of the forming arm 20. The width of shim plate 16 is narrow enough that forming arm 20 will be vertically upright at its most counterclockwise position. This position coincides with the transition of the forming plate outer periphery from straight to curved. Because of the smoothness and low friction characteristics of the formica surface on mounting plate 10 and the forming plate 14, forming arm 20** can be moved through the slot between the two easily even though the fit is tight.

Figure 3:
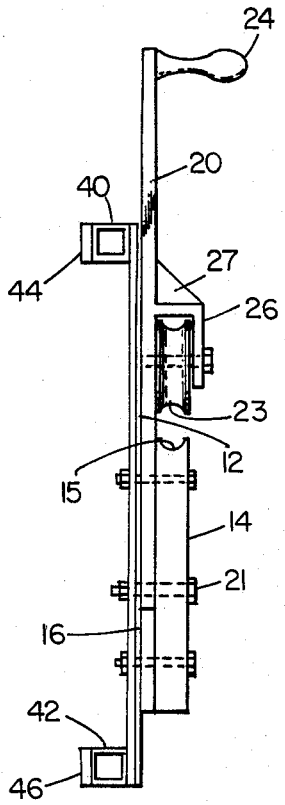
FIG. 3 is a side elevation view of the bender of FIG. 1 with a portion broken away to show the mounting and arrangement of the forming roller arm.

Forming arm 20 is made of a rectangular steel bar and mounts a forming roller 22 made of No. 101 Nylon. Roller 22 is provided with a grooved periphery, the same as forming plate 14. It is mounted radially outward from the forming plate periphery a sufficient distance to enable a metal tube to be inserted and removed from the adjacent grooves; 15 in plate 14 and 23 in roller 22. Roller 22 is journal- mounted on arm 20, in the same plane as forming plate 14, between the arm and a bracket 26 extending out from the arm as shown in FIG. 3. Bracket 26 is welded to arm 20 and reinforced by a web 27.

Clamping assembly 18 comprises a toggle arm 30 having a plunger shaft 32 pivotally connected to the lower end of the toggle arm and a clamp member 34 adjustably mounted to the lower end of shaft 32. Clamp member 34 has a lower edge provided with a semicircular groove 35 opposite the groove in the straight section **14*a* in the forming plate 14. A mounting bracket 37 fastened to mounting plate 10, mounts toggle arm 30 and a retaining sleeve 36 for shaft 32. Clamp member 34 is adjustably mounted to the end of shaft 32** by a threaded pin and held in position by an adjustment nut 38. Clamp member 34 is adjusted so that a metal tubing section will be firmly gripped between the clamp and the forming plate when the toggle arm is locked down and the plunger shaft 32 is completely extended.

Mounting plate 10 is reinforced by upper and lower horizontal square metal tubes 40 and 42. These tubes are welded to the back of mounting plate 10 and are in turn welded to upper and lower steel attachment bars 44 and 46, respectively. The metal bars are provided with bolt holes for attachment to a wall. These holes are spaced to permit attachment to wall studs spaced at 16 inch and 24 inch on-center-intervals to facillitate fastening to studs by means of lag screws, if needed.

In operation, a section of metal tubing is inserted between clamp member 34 and forming roller 22, on the top, and forming plate 14 on the bottom. The tubing section is placed in the straight groove in forming plate section 14*a* and the clamp member 34 is toggled down into clamping engagement with the tubing. Then, the operator grasps the handle 24 on the end of the forming arm 20 and rotates the forming arm down in a clockwise direction against the tubing. As the arm is rotated downward, the tubing will be bent into conformance with the arcuate (circular) configuration of the grooved periphery 14*b* of the forming plate 14. The forming arm is rotated downward until the desired bend in the tubing is attained. With the configuration of the forming plate shown, a bend of at least 95 degrees can be easily attained. Because the forming arm 20 is confined between the formica facing and the forming plate 14, the forming roller 22 will be maintained in a co-planar relationship with the forming plate. Therefore, the bend placed in the tubing will itself be co-planar and not warped. The tubing in only contacted by Nylon members and therefore will not be marred by the bending operation. Moreover, if any metal burrs get on the bender, they will not be readily transferred to the tubing. The Nylon is self-lubricating and the tubing is less likely to be scratched by the bending operation.

The bender shown in the Figures, is a "right hand" bender. By turning the forming plate 14 over and reversing the positions of the shim plate 16 and the clamping assembly 18, a mirror image "left hand" bender will be produced.

The reinforcing tubes 40 and 42 also serve to space the device out from a wall to which it is attached. Therefore, the tube bending elements of the device are spaced outward a sufficient distance to facillitate insertion and removal of a tubing section.

Figure 5:
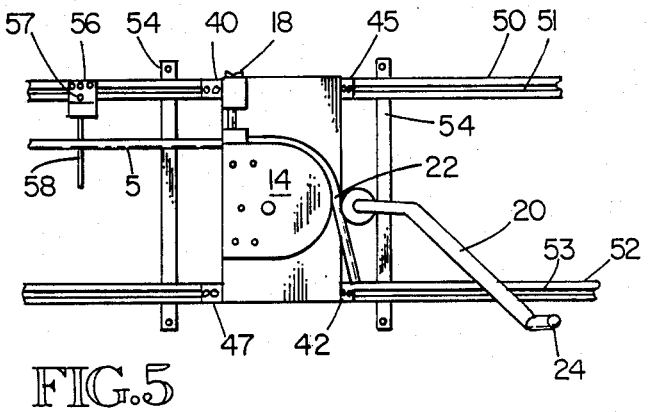
FIG. 5 depicts the FIGS. 1–4 tube bender mounted on an adjustable rail system designed to perform left and right hand bends in tubing stock.

In FIG. 5, the "right hand" bender is shown adjustably mounted onto a pair of slotted rails 50 and 52. These rails may be fabricated from steel channels and provided with longitudinal slots 51 and 53. The bender reinforcing tubes 40 and 42 are mounted on fasteners 45 and 47 that extend into the rail slots and are adapted to clamp the bender onto the rails at any desired location therealong. The rails 50 and 52 are located parallel to one another by cross members 54, which members are provided with mounting holes for vertically mounting the assembly onto a wall or the like. The rails are long enough that a "left hand" bender (not shown) may be mounted thereon leftward of the view shown in FIG. 5. A center-indicating wand 58, carried by a rail clamp 56 may be located along the upper rail 50 to indicate the center position between a set of "left hand" and "right hand" benders. Clamp 56 may be clamped to rail 50 be means of fastener 57, which is similar to fasteners 45 and 47. In operation, the system of FIG. 5 would have a piece of tubing stock 5 mounted into the pair of benders, with the tubing stock piece center located above the system centering wand 58. Then, each bender may be operated as hereinbefore described to provide left and right hand bends equi-distant from the tubing center.

FIG. 5 also depicts the forming arm 20 as being "dog-legged" in that it contains an obtuse-angled bend just outward of the forming roller 22. The orientation of the dog-leg is rightward for a "right hand" bender, and leftward for a "left hand" bender; the bender of FIG. 5 showing a right hand orientation. When the assembly is vertically-mounted, such as on a wall, the dog-legged handle facilitates the bending operation at the onset, in that an operator may grasp the handle 24 and commence pulling downward rather that commencing to pull horizontally and then downward.

While a preferred embodiment of the tubing bender of this invention has been described, certain changes may be made without departing from the scope of the invention. Consequently, the scope of the invention is only to be delimited by the appended claims herein.

What is claimed is:

1. A metal tube bending apparatus comprising a mounting plate; a forming plate overlaying a portion of said mounting plate and being shimmed and mounted to said mounting plate whereby a working space is provided between the opposing faces of said forming plate and said mounting plate, said mounting plate having a co-planar non-metallic surface facing said forming plate and extending beyond the periphery of said forming plate, said forming plate having a forming edge along the periphery thereof provided with a tube-receiving perhipheral groove; a forming arm pivotally mounted to said mounting plate and positioned to pivotally move in said working space; a forming roller journal-mounted to said forming arm in outwardly-spaced relationship to the forming plate periphery, said forming roller being provided with a peripheral groove and mounted by said arm co-planar with said forming plate so as to confine a tubing section and provide a co-planar bend therein during operation of said bending apparatus; a tubing clamping assembly mounted on said mounting plate in position to clamp tubing against said forming plate; said forming plate periphery having a tangential portion opposite said clamping assembly and an arcuate portion; said forming arm being positioned to move, within said working space, to move said forming roller in an arc parallel to said forming plate arcuate groove portion; a shim plate positioned at the rearward end of said mounting plate betweeen said mounting plate and said forming plate below the position of said clamping assembly whereby said forming plate is shimmed out from said mounting plate to provide said working space, said shim plate having an inward vertical edge against which said forming arm can abut to position said forming roller adjacent said forming plate tangential groove for commencement of a tubing bending operation, and said shim plate having a thickness only slightly greater than the thickness of said forming arm whereby said forming arm is confined and guided by the adjacent facing surfaces of said mounting plate and said forming plate so as to maintain the co-planar relationship between said forming plate and said forming roller when said forming arm is moved in said working space during a tube bending operation.

2. The bending apparatus according to claim 1 wherein said mounting plate is provided with upper and lower reinforcing tubes secured to the backside thereof, and wherein attachment means are secured to said reinforcing tubes for attachment of said bending apparatus to a wall, whereby the forming elements of said apparatus will stand out from a wall to facilitate inserting and removing a tubing section from said apparatus.

3. The bending apparatus according to claim 1 wherein said mounting plate is faced with a low-friction, non-metallic material to protect a tubing section from abrasion and to facilitate movement of said forming arm during a bending operation.

4. The bending apparatus according to claim 1 wherein a pair of longitudinal rails are provided and said mounting plate is provided with upper and lower reinforcing tubes secured to the backside thereof, and wherein fastener means are provided on said reinforcing tubes for adjustable attachment of said bending apparatus said rails, whereby the forming elements of said apparatus will stand out from a wall to facillitate inserting and removing a tubing section from said apparatus.

5. The bending apparatus according to claim 4 wherein an additional bender, of opposite hand, is provided and likewise mounted to said rails, the two benders being oriented such that one is a right hand bender and the other is a left hand bender, the left hand bender being mounted to said rails leftward of said right hand bender.

6. The bending apparatus according to claim 1 wherein said forming arm is provided with an obtuse dog-leg angle outward of said forming roller to facilitate commencement of a bending operation, the orientation of said dog-let angle being in the direction of bending.

7. The bending apparatus according to claim 4 wherein said longitudinal rails are each provided with outwardly-facing longitudinal slots; and wherein said fastener means include means that engage said slots whereby said fastener means are confined in and may be slid along said slots for the positioning of said mounting plate relative to said rails.

8. The bending apparatus according to claim 1 wherein said forming arm comprises a flat bar having a thickness only slightly less than the thickness of said shim plate whereby the side faces of said flat bar are confined and guided by the adjacent facing surfaces of said mounting plate and said forming plate.

9. The bending apparatus according to claim 4 wherein said forming arm comprises a flat bar having a thickness only slightly less than the thickness of said shim plate whereby the side faces of said flat bar are confined and guided by the adjacent facing surfaces of said mounting plate and said forming plate.

* * * * *